United States Patent [19]

Correia

[11] 4,232,916

[45] Nov. 11, 1980

[54] DEMOUNTABLE AND STACKABLE MULTIPURPOSE CONTAINER

[76] Inventor: Daniel Correia, 226 Sierra Dr., Walnut Creek, Calif. 94596

[21] Appl. No.: 964,263

[22] Filed: Nov. 27, 1978

[51] Int. Cl.[3] ..... A47B 87/00; A47B 47/00

[52] U.S. Cl. ..... 312/107; 312/108; 312/111; 312/257 R; 312/263; 211/194; 108/53.3

[58] Field of Search ..... 312/107, 108, 111, 263, 312/244, 257; 211/126, 189, 194; 108/53.3, 91

[56] References Cited

U.S. PATENT DOCUMENTS

| | | | |
|---|---|---|---|
| 873,496 | 12/1907 | Bryant | 312/107 |
| 1,282,833 | 10/1918 | Holder | 312/108 |
| 3,347,610 | 10/1967 | Pilliod | 312/108 |
| 3,410,441 | 11/1968 | Rhyne | 312/263 |
| 3,432,216 | 3/1969 | Yang | 312/111 |
| 3,552,817 | 1/1971 | Marcolongo | 312/107 |
| 3,644,008 | 2/1972 | Overby | 312/107 |
| 3,862,689 | 1/1975 | Taub | 211/126 |
| 3,885,845 | 5/1975 | Krieks | 312/108 |
| 4,103,782 | 8/1978 | Mayer | 312/107 |
| 4,105,182 | 8/1978 | Jacobson | 211/42 |

FOREIGN PATENT DOCUMENTS

| | | | |
|---|---|---|---|
| 1363227 | 5/1964 | France | 312/108 |
| 1465101 | 1/1967 | France | 312/111 |

*Primary Examiner*—Victor N. Sakran
*Attorney, Agent, or Firm*—Robert R. Tipton

[57] ABSTRACT

A knock-down, stackable multipurpose container utilizes a pair of end members or panels having a number of slots or devices for slidably engaging various top, side, bottom and intermediate spacer members or panels. The top edge of the end members is provided with a raised portion which, in the embodiment described, defines a handle. The bottom edge of the end members is provided with a recess adapted to receive and engage the raised portion or handle of an identical multipurpose container. The bottom panel is adapted to cooperate with the bottom recess of the end member to maintain vertical alignment of the stacked containers.

1 Claim, 7 Drawing Figures

FIG. 5
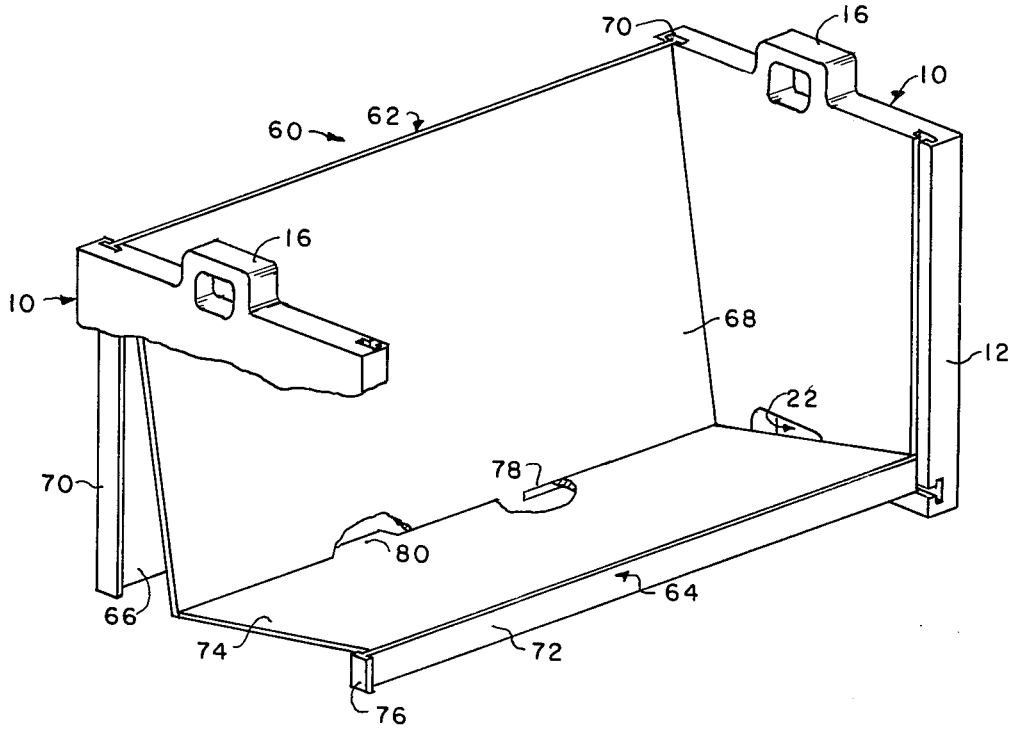
FIG. 6
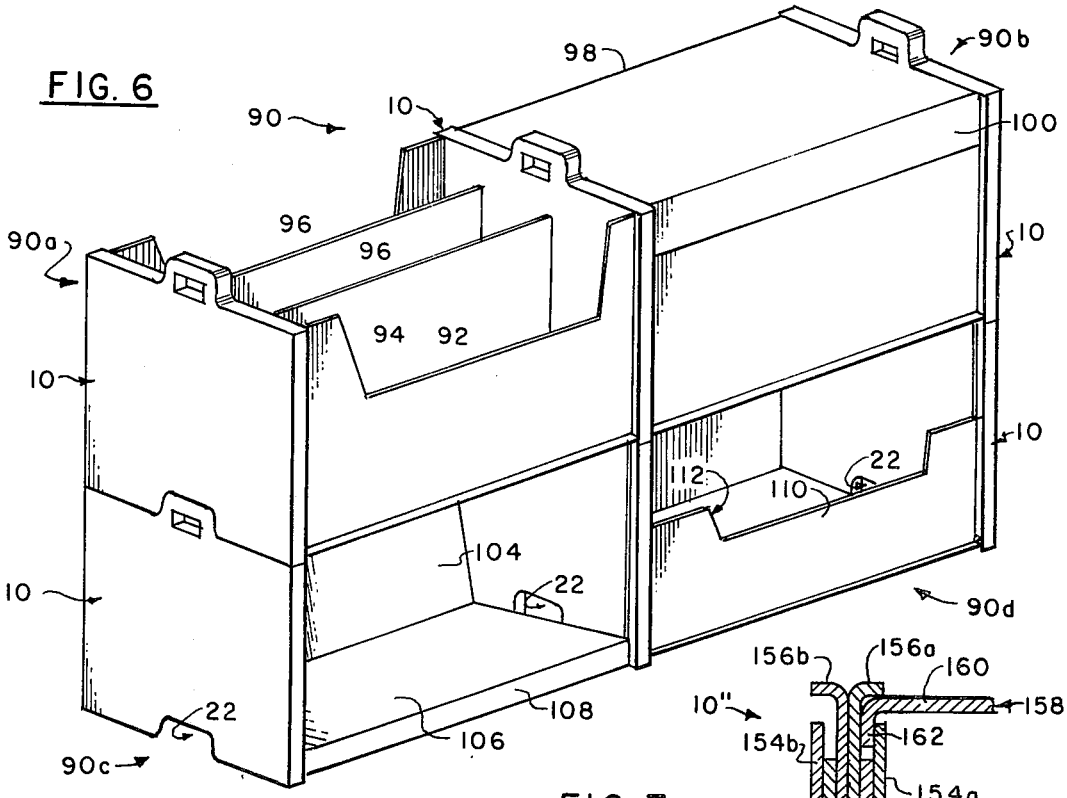
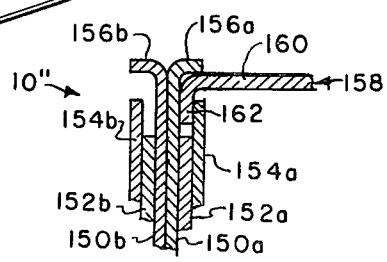
FIG. 7

DEMOUNTABLE AND STACKABLE MULTIPURPOSE CONTAINER

BACKGROUND OF THE PRIOR ART

This invention relates generally to containers and in particular to stackable containers that can be stacked, as well as assembled and disassembled without the use of tools.

The so-called portable and stackable book shelves or containers of the prior art usually comprise devices that have interlocking grooves that hold the stacked bookcases together, each bookcase being a single integrated unit. If the containers were to be stored when empty, they were hinged at several places to make them collapsible to conserve storage space. In all cases the individual containers were designed to perform only one function or were used for only one purpose. Other bookcases or containers, if demountable, were not stackable, or were constructed to define only one configuration.

SUMMARY OF THE INVENTION

The multipurpose container of the present invention is a demountable and stackable container having a variety of interchangable panel members which engage a pair of end members in various combinations to produce a multipurpose container comprising, basically, a pair of end members having means for slidably engaging a variety of top, side, bottom and intermediate spacer panels, the top edge of the end members having a raised portion with the bottom edge of the end members having means defining a recess adapted to receive the raised portion of a like end member of another multipurpose container to prevent front and back movement. The bottom panel is adapted to engage the end members proximate the bottom edge of the end member. The bottom panel further comprises a recess adapted to cooperate with recess in the bottom edge of the end member to vertically align the stacked, multipurpose containers to prevent side movement.

The various panels are also adapted to slidably engage the end members whereby the container can be assembled and disassembled without the use of tools.

It is, therefore, an object of the present invention to provide a stackable and demountable multipurpose container.

It is another object of the present invention to provide a multipurpose container that is convertible into a container useful for various purposes such as an open book shelf, a storage container for office files, a parts bin, a magazine rack, etc.

It is a further object of the present invention to provide a multipurpose container that is horizontally interconnectable with like containers while also being stackable.

It is a further object of the present invention to provide a multipurpose container that is stackable in its variety of conditions and for a variety of uses.

It is still another object of the present invention to proved a stackable multipurpose container in which the bottom panels and end members cooperate to provide vertical alignment of the stacked containers.

These and other objects of the present invention will be manifest upon study of the following detailed description when taken together with the drawing.

BRIEF DESCRIPTION OF THE DRAWINGS

FIG. 5 is an isometric partial cut-away view of a typical container of the present invention showing its conversion to use as a book shelf.

FIG. 6 is an isometric view of a set of four stackable multipurpose containers of the present invention showing the stackability of the units used for different purposes and arranged in a locked end-to-end configuration with adjacent containers having a common end member.

FIG. 7 is a cross-sectional view of another embodiment of a method for slidably connecting a side panel to an end member when fabricated out of sheet metal.

DESCRIPTION OF THE PREFERRED EMBODIMENT

Figure 1:
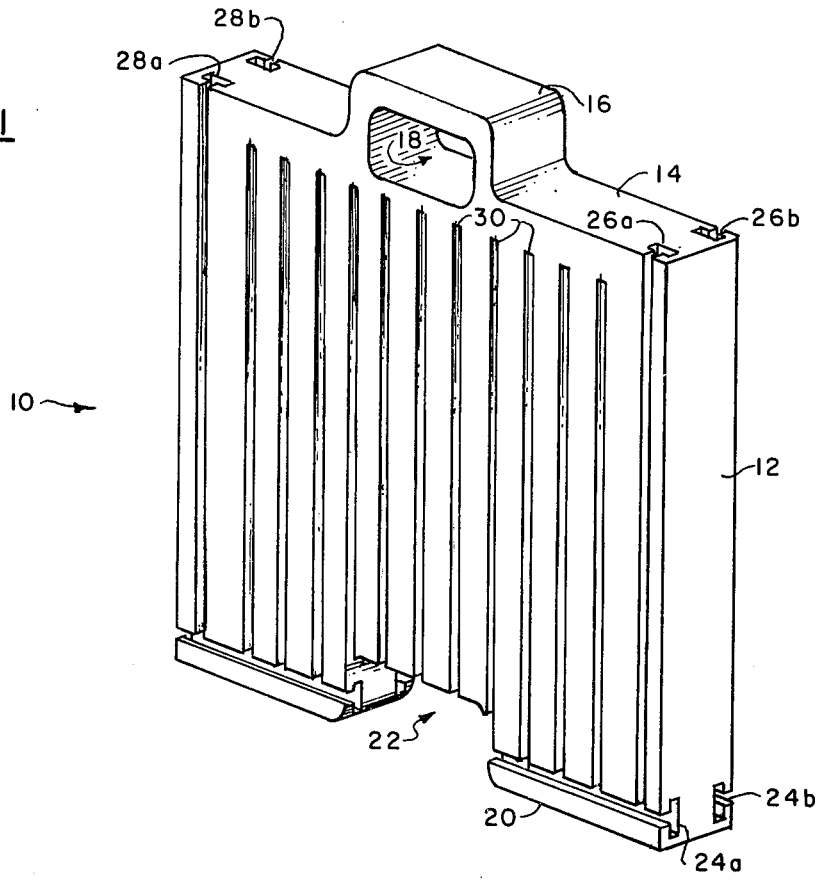
FIG. 1 is an isometric view of a typical end member of the stackable, multipurpose container of the present invention.

With reference to FIG. 1, there is illustrated a typical end member or support 10 of the demountable, multipurpose container of the present invention comprising, basically, a body portion 12 having a top side or edge 14 on which is located a protrusion 16 which, in the embodiment illustrated, defines a handle having a finger hole 18.

Body portion 12, along its bottom side or edge 20, further comprises a recess 22 having an inside dimension that is approximately equal to the outside dimension of protrusion 16 and adapted to receive and engage a like protrusion of an end or support member 16 of another demountable, multipurpose container as described herein.

End member 10 further comprises a bottom locking groove or T-slot 24, shown as T-slot **24*a* on one face of body portion 12 and as a like T-slot 24*b* on the opposite face of body portion 12, both T-slots being parallel and spaced apart from the bottom edge or side 20. In addition, a side or vertical locking groove or T-slot 26 and 28 are located parallel to the vertical sides or edges of body portion 12, and shown as T-slots 26*a* and 26*b* on opposite faces of body portion along one vertical edge of and T-slots 28*a* and 28*b* on opposite faces of body portion 12** along the other vertical side or edge. Although T-slots are shown in the illustrated embodiment, other types of slots may be used such as round, groove or dove-tail. That is, slots that have a narrow entrance opening and a wide recessed portion.

Disposed on each face of body portion 12 are a plurality of vertical grooves 30 which are adapted to receive the ends of spacer panels 46 (FIGS. 2 and 96 (FIG. 6) described below.

It will be noted that T-slots 26*a*, 26*b*, 28*a* and 28*b* are arranged to extend from the top edge 14 of body portion 12 down to T-slots 24*a* and 24*b*.

Figure 2:
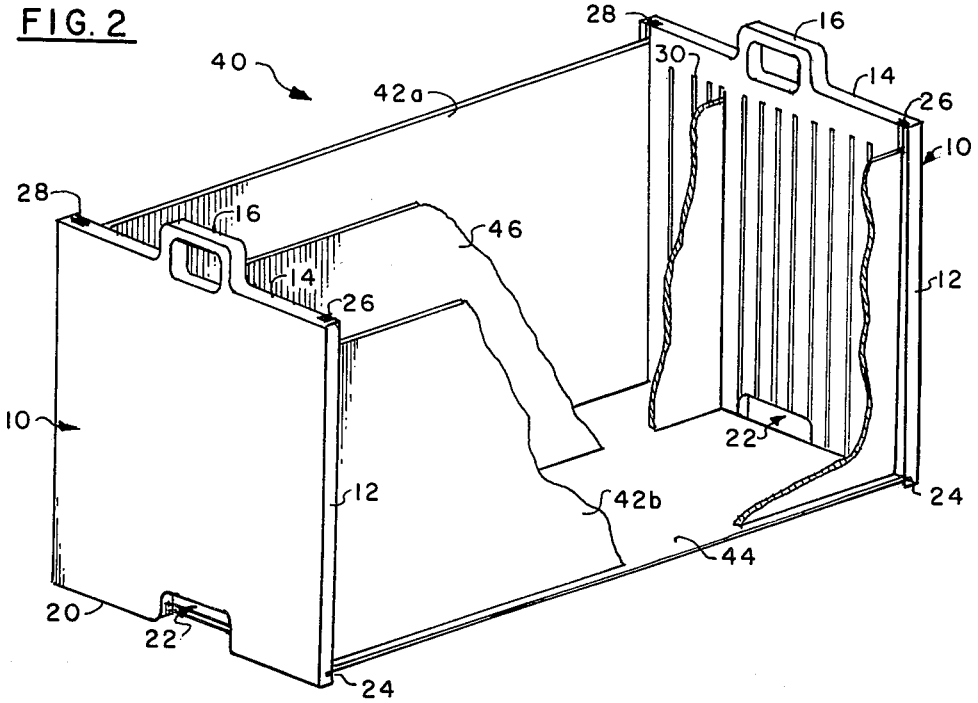
FIG. 2 is an isometric, partial cut-away view of a typical stackable, multipurpose container of the present invention showing it in its assembled configuration.

With reference to FIG. 2, there is illustrated a typical assembled container 40 of the present invention showing a pair of end members 10 spaced apart and supported by bottom support panel 44 in cooperation with side support panels 42*a* and 42*b*. The ends of panels 42*a* and 42*b* are adapted to slidably engage T-slots 24 (24*a*, 24*b*), 26 (26*a*, 26*b*) and 28 (28*a*, 28*b*) in end members 10. A typical spacer panel 46 is shown engaging one of slots 30 in end member 10.

Figures 3, 4:
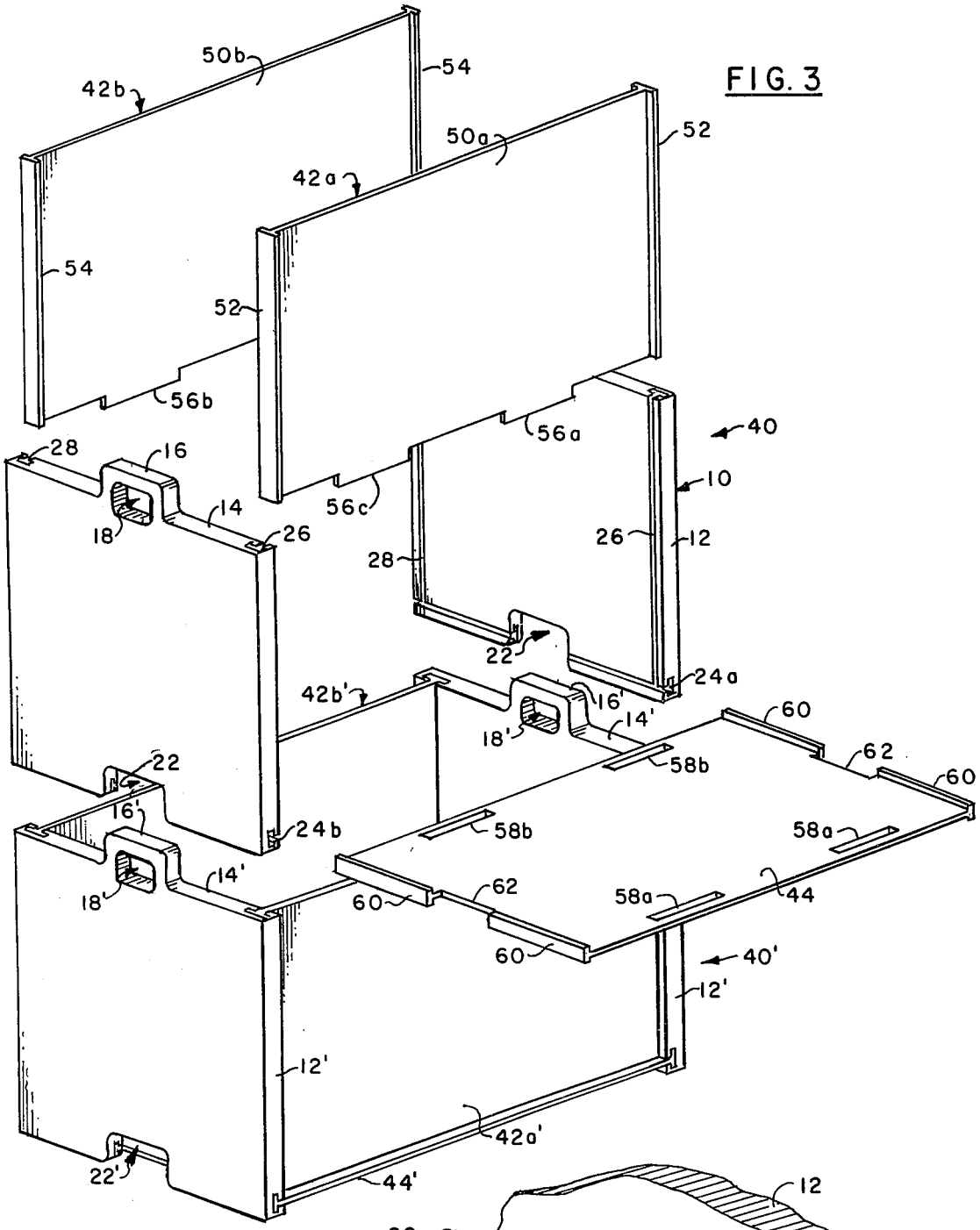
FIG. 3 is an isometric exploded view of a pair of demountable and stackable, multipurpose containers of the present invention showing the method of assembly of the containers and the manner and method by which they are stacked.
FIG. 4 is an isometric cut-away view of that portion of two stacked containers showing the relationship between the bottom support panel of the top container and the mating protuberance of the bottom container end member.

To illustrate how the various parts fit together, reference is made to FIG. 3 which is an isometric view of the demountable and stackable multipurpose container of the present invention showing the various parts and, additionally showing a bottom container on which the upper container is stacked. For simplification, FIG. 3 shows T-slots only on the inner sides of end members 10.

As can be seen from FIG. 3, side panels 42*a* and 42*b* comprise a flat portion 50*a* and 50*b*, respectively, having a spline or T-member 52 and 54, respectively, along each vertical end. Spline or T-member 52 and 54 are adapted to fit into and slidably engage T-slots 26 and 28, respectively, thus locking the ends of panels 42*a* and 42*b* firmly in and supporting, end members 10.

Side panels 42*a* and 42*b* further comprise a set of tabs 56*a* and 56*b*, respectively, located along the bottom edge of flat portions 50*a* and 50*b*, respectively, which are adapted to engage slots 58*a* and 58*b* of bottom panel 44.

Bottom panel 44 comprises splines or T-members 60 at each end of panel 44 which are adapted to fit into and slidably engage T-slots 24 in end member 10. A recess 62 is provided in bottom panel 44 which interrupts T-member 60 at a point corresponding to the approximate location of recess 22 when panel 44 is properly engaged with end member 10. In addition, a recess 62 is provided in bottom panel 44 which is adapted to be deep enough to clear upward protrusion or handle 16' of container 40' upon which container 40 is stacked.

The particular relationship between panel 44, its recess 62 and protrusion or handle 16' of bottom container 40' is illustrated in FIG. 4.

FIG. 4 is an isometric view from the inside of upper container 40 looking toward the junction of upper container 40 with lower container 40'.

It can be seen that recess 62 of panel 44 meets the side of protrusion or handle 16' and thus keeps it in vertical side-ways alignment with end member 10 of upper container 40. By virtue of protrusion 16' being received in recess 22, vertical front-to-back alignment of containers 40 and 40' is also maintained.

With reference to FIG. 5, there is illustrated a partial cut-away isometric view of a book shelf version of container 60 of the present invention which comprises end members 10 illustrated in FIG. 1 which are spaced apart by and attached to back support member 62 and bottom shelf member 64.

Back support member 62 comprises a side panel 66 similar to side panels 42*a* and 42*b* of FIG. 3, and slanting back support 68 attached at its top edge to the top edge of side panel 66 and disposed at an angle depending downwardly therefrom.

At each end of side panel 66 is spline or T-member 70 adapted to fit in and slidably engage T-slot 28*a* and 28*b* of end member 10 (FIG. 1) in the same manner as previously described for the container illustrated shown in FIG. 3.

Bottom shelf member 64 comprises a front edge member 72 and a bottom panel 74. A spline or T-member 76, adapted to fit in and slidably engage T-slot 26*a* and 26*b* of end member 10 (FIG. 1), is located at each end of front edge member 72 in a manner as previously described for back support member 62 of FIG. 5 and the side panels 50*a* and 50*b* illustrated in FIG. 3.

Slanting back support 68 further comprises a pair or slots 78 which are adapted to receive and engage tabs 80 along the back edge of bottom panel 74.

It will be noted that bottom panel 74 is arranged to pass across recess 22 of end member 10 in a manner similar to bottom panel 44 of FIGS. 3 and 4 to provide vertical side-ways alignment of the stacked containers.

With reference to FIG. 6, there is illustrated a set of four demountable and stackable multipurpose containers 90 of the present invention showing them stacked and connected in an end-to-end configuration for different uses.

For example, container 90*a* illustrates a configuration used as a magazine rack or office file holder in which side panels 90 comprise a cut-away portion 94 so that the face of the magazine or file can be readily seen. Container 90*a* further comprises divider panels 96 which are used to maintain the magazines or files in a vertical position.

Container 90*b* illustrates a container configuration used for closed storage comprising a top or cover 98 with downward depending sides 100 adapted to meet side panels 102, thus providing and enclosed container.

Container 90*c* illustrates a container configuration used as a book shelf as shown in FIG. 5, and comprises a back support panel 104, a bottom support shelf 106 having a front edge portion 108.

Container 90*d* illustrates a container configuration used as a parts bin comprising a shallow side panel 110 having a cut-away portion 112 to permit access to the interior of container 90*d* while in the stacked configuration.

It will be further noted that containers 90*a* and 90*b* have a common end member 10 as do containers 90*c* and 90*d*. It can be seen from FIG. 1 that T-slots are located on both sides of body portion 12 thus affording such use as a common end member. Thus any number of containers can be serially assembled end-to-end using a common end member 10 to achieve a structurally sound, rigid and strong stacked container structure.

With reference to FIG. 7, there is illustrated a cross-section of a further embodiment of a connecting joint of the present invention that could be used in lieu of T-slots 24*a*, 24*b*, 26*a*, 26*b*, 28*a* and 28*b* shown in FIG. 1.

The joint configuration of FIG. 7 shows a portion of a metal end member 10'' in cross-section and comprises a pair of central locking members 150*a* and 150*b* spaced apart by spacer members 152*a* and 152*b* from outer panel members 154*a* and 154*b*.

Central locking members 150*a* and 150*b* are deformed at their outer ends to define an "L" shaped section 156*a* and 156*b*, respectively, and are attached to each other back-to-back. All of the members 150*a*, 150*b*, 152*a*, 152*b*, 154*a* and 154*b* are attached to each other as by welding or the like, with the ends of members 154*a* and 154*b* spaced apart from the deformed "L" portion 156*a* and 156*b* of central members 150*a* and 150*b*, respectively.

A typical side panel 158 comprises a flat side portion 160 having a deformed "L" shaped portion 162 adapted to fit into and slidably engage the space between central member 150*a*, "L" portion 156*a* and outer panel member 154*a* as shown. It will also be noted that spacer member 152*a* should be slightly thicker than the thickness of side panel 158 in order to permit assembly of the parts without undue force.

Thus, it can be seen that other shapes and sizes of side panels and spacer panels can be used to produce containers that are adaptive to other uses and still be stackable and demountable.

I claim:

1. A multipurpose container comprising a pair of end members having a face, a top edge, a first side, a second side and a bottom edge, a first slot having a narrow opening width and a wide recessed width, said first slot disposed on said face of said end member parallel to and proximate said bottom edge of said end member, a second slot having a narrow opening width and a wide recessed width, said second slot disposed on said face of said end member parallel to and proximate said first side edge of said end member, a third slot having a narrow opening width and a wide recessed width, said third slot disposed on said face of said end member parallel to and proximate said second side edge of said end member, a plurality of spacer slots disposed on said face of said end member, said spacer slots being disposed parallel to said first and second side edges and equally spaced along said face, a variety of top and side members, said members having top, bottom, first and second end edges and comprising means along said end edges for slidably engaging said second and third slots of said end members and being retained therein, a bottom member having first and second end edges and comprising means along said end edges of said bottom member for slidably engaging said first slot of said end member and being retained therein, means defining a raised portion disposed on said top edge of said end member, means defining a recess in said bottom edge of said end member adapted to receive a like raised portion of another end member of a like multipurpose container, and means defining a recess in said end edges of said bottom member, said recess adapted to receive and cooperate with said raised portion of a like multipurpose container end member to vertically align said stacked multipurpose containers.

* * * * *